US011344101B2

(12) United States Patent
Leroux et al.

(10) Patent No.: US 11,344,101 B2
(45) Date of Patent: May 31, 2022

(54) ASSEMBLY COMPRISING A SYSTEM FOR PACKAGING AND APPLYING A PRODUCT, NOTABLY A COSMETIC PRODUCT, AND DEVICE FOR PROTECTING THE SAID SYSTEM

(71) Applicant: L'Oreal, Paris (FR)

(72) Inventors: Stéphane Leroux, Clichy (FR); Gianluca La Montagna, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 17/253,570

(22) PCT Filed: Jun. 20, 2019

(86) PCT No.: PCT/EP2019/066415
§ 371 (c)(1),
(2) Date: Dec. 17, 2020

(87) PCT Pub. No.: WO2019/243551
PCT Pub. Date: Dec. 26, 2019

(65) Prior Publication Data

US 2021/0267354 A1 Sep. 2, 2021

(30) Foreign Application Priority Data

Jun. 22, 2018 (FR) ..... 1855584

(51) Int. Cl.
*A45D 40/26* (2006.01)
*A45D 34/04* (2006.01)
*A45D 40/10* (2006.01)

(52) U.S. Cl.
CPC ..... *A45D 40/267* (2013.01); *A45D 34/046* (2013.01); *A45D 40/10* (2013.01)

(58) Field of Classification Search
CPC .. A45D 34/043; A45D 34/045; A45D 34/046; A45D 40/02; A45D 40/264; A45D 40/265; A45D 40/267
(Continued)

(56) References Cited

U.S. PATENT DOCUMENTS 1,216,070 A * 2/1917 Carlson ..... B43K 23/00 401/81
7,118,298 B2 * 10/2006 Tsutsumi ..... A45D 34/045 401/129

(Continued)

FOREIGN PATENT DOCUMENTS

| | | | |
|---|---|---|---|
| FR | 2936939 | A1 | 4/2010 |
| FR | 3024338 | A1 | 2/2016 |
| WO | 2010/106065 | A1 | 9/2010 |

OTHER PUBLICATIONS

International Search Report dated Aug. 26, 2019, issued in corresponding International Application No. PCT/EP2019/066415, filed Jun. 20, 2019, 2 pages.

*Primary Examiner* — David P Angwin
*Assistant Examiner* — Bradley S Oliver
(74) *Attorney, Agent, or Firm* — Christensen O'Connor Johnson Kindness PLLC

(57) ABSTRACT

Assembly including a system for packaging and applying a product and a device for protecting the said system further including a sleeve inside which the system is mounted with the ability to move axially between a storage position and a usage position in which at least one applicator partially projects out from the sleeve, a release device provided with means for immobilizing the system relative to the sleeve in the storage position, and an actuating means for rendering the immobilizing means inactive, and an elastic preload member applying an elastic load to the system, where release means further include retaining means for restraining (Continued)

Figure 3:
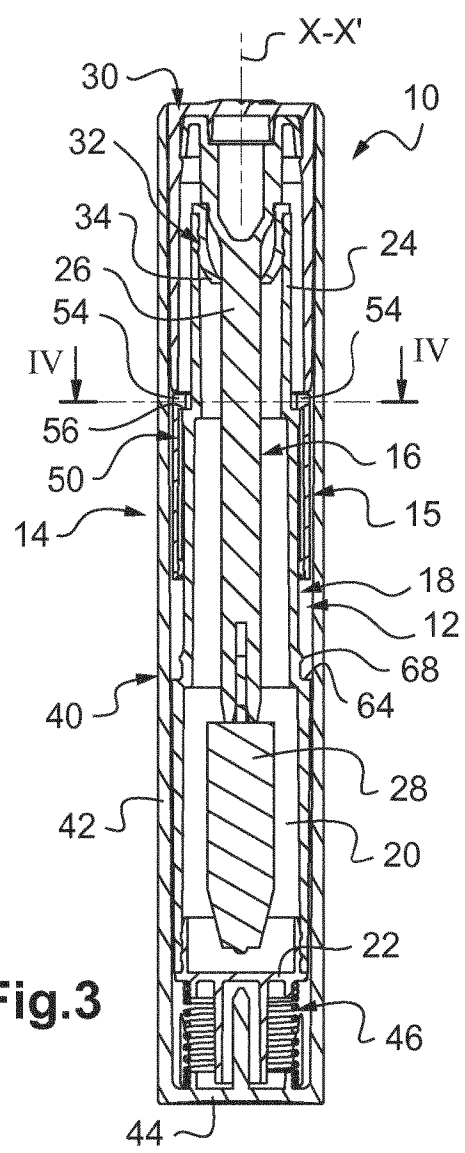

the said system relative to the sleeve in the usage position and which are configured to oppose the movement of the said system towards the storage position.

13 Claims, 4 Drawing Sheets

(58) Field of Classification Search
USPC ..... 401/81, 112–114
See application file for complete search history.

(56) References Cited

U.S. PATENT DOCUMENTS

| | | | | |
|---|---|---|---|---|
| 7,874,753 | B2 * | 1/2011 | Domy | A45D 40/10 401/99 |
| 8,113,350 | B2 * | 2/2012 | Sanchez | A45D 40/00 206/581 |
| 8,287,199 | B2 * | 10/2012 | Salciarini | A45D 34/046 401/109 |
| 8,287,201 | B2 * | 10/2012 | Salciarini | A45D 34/046 401/126 |
| 8,783,988 | B2 * | 7/2014 | Sanchez | A45D 40/26 401/126 |
| 9,375,072 | B2 * | 6/2016 | Drugeon | A45D 40/26 |
| 10,130,157 | B2 * | 11/2018 | Fogueteiro | A45D 34/046 |
| 11,140,964 | B2 * | 10/2021 | Shen | A45D 34/043 |

* cited by examiner

ASSEMBLY COMPRISING A SYSTEM FOR PACKAGING AND APPLYING A PRODUCT, NOTABLY A COSMETIC PRODUCT, AND DEVICE FOR PROTECTING THE SAID SYSTEM

The present invention relates to an assembly comprising a system for packaging and applying a product, notably a cosmetic product, and to a device for protecting the said system.

The expression "cosmetic product" is understood to mean a product as defined in Regulation (EC) No 1223/2009 of the European Parliament and of the Council of 30 Nov. 2009 relating to cosmetic products.

The present invention relates more particularly to an assembly comprising a packaging and application system of the type comprising a container for storing the product, and an applicator mounted removably between a withdrawing position for withdrawing product contained in the said container and an application position in which the applicator is separated from the said container.

Conventionally, the protection device for such an assembly comprises a sleeve inside which the packaging and application system is mounted in such a way that it can move axially between a retracted storage position and a deployed usage position in which the applicator projects out from the sleeve so that it can be extracted by the user.

In general, the assembly also comprises means for immobilizing the storage container when the packaging and application system is in the storage position. These means may be rendered inactive by the user from the outside of the sleeve in order to allow passage into the usage position under the action of a spring mounted between the bottom of the sleeve and the bottom of the container.

For more details on the design of such an assembly, reference can be made for example to Patent Applications FR-A1-2 982 132 and FR-A1-3 024 338.

When the product is being applied, if the user wishes to reload the applicator with product, he/she dips it once again into the storage container of the packaging and application system.

However, in the deployed usage position of the system, the storage container is held in position solely under the action of the spring.

When the applicator is introduced into the storage container, rubbing contact between these two means, for example at a wiping member fixed in the neck of the container, causes the said container to move downwards inside the sleeve of the protection device.

It can therefore be readily appreciated that, in this deployed usage position of the packaging and application system, movements of the applicator relative to the storage container in order to reload the applicator with product or extract it for the purposes of application cause the container to move.

That detracts from the quality perceived by the user of such an assembly.

The present invention aims to overcome this drawback.

One subject of the invention is an assembly comprising a system for packaging and applying a product, and a device for protecting the said system.

The packaging and application system comprises a container for storing the said product, and an applicator mounted removably between a withdrawing position for withdrawing product contained in the said container and an application position in which the applicator is separated from the said container.

The protection device comprises a sleeve inside which the packaging and application system is mounted is such a way that it can to move axially between a storage position and a usage position in which at least the applicator partially projects out from the sleeve.

The assembly further comprises a release device for releasing the packaging and application system, this being provided with means for immobilizing the said system relative to the sleeve in the storage position, and an actuating means for actuating the immobilizing means in order to render the said immobilizing means inactive and detach the said system and the said sleeve by actuating the said actuating means.

The assembly also comprises an elastic preload member applying elastic load to the packaging and application system for the passage of the said system from the storage position to the usage position when the immobilizing means are in the inactive position.

According to one overall feature of the invention, the release device further comprises retaining means for restraining the said system relative to the sleeve in the usage position and which are configured to oppose the movement of the said system towards the storage position. The retaining means are distinct from the elastic preload member.

Thus, when the user wishes to reload the applicator with product, the rubbing contact that exists as the latter is introduced into the container does not cause the container to retreat into the sleeve of the protection device.

During this reloading with product, the user can therefore move the applicator back and forth inside the container without the said container moving.

For preference, the retaining means of the release device are configured to apply an axial retaining force restraining the said system relative to the sleeve and which force is higher than a force of insertion of the applicator into the storage container.

What is meant by a "force of insertion of the applicator" is the axial thrust force that the user needs to exert in order to introduce the applicator into the container into its product collecting position bearing in mind the rubbing contact, notably in the radial direction, between the applicator and the container during this introduction.

With such a design, when the packaging and application system is in the usage position, the risk of axial detachment of the said system relative to the sleeve when the user introduces the applicator into the container solely with a view to reloading it with product is limited.

Furthermore, actuation by the user of the actuating means allows the immobilizing means to pass from the active position of restraining the system relative to the sleeve in its storage position, into the inactive position that allows the system to move axially relative to the sleeve. The actuating means may be accessible from the outside.

The applicator may comprise a stem and at least one application member for applying the said product which is arranged on the stem and which is at least partially situated inside the storage container and brought into contact with the product contained in the said container in the pickup position.

When the applicator is being introduced into the storage container, the rubbing contact is chiefly between the container and the stem of the applicator, and/or between the container and the application member of the applicator.

According to one particular design, the packaging and application system may further comprise a wiping member fixed in a neck of the container and designed to scrape the stem, and/or the application member of the applicator as it is being extracted from the container. When the applicator is being introduced into the container, the rubbing contact is chiefly between the wiping member and the stem of the applicator, and/or between the said wiping member and the application member of the applicator.

In one particular embodiment, the axial retention force applied by the retaining means of the release device is higher than the axial load applied by the elastic preload member when the packaging and application system is in the usage position.

Thus, the user does not feel any sticking point just after having detached the packaging and application system from the sleeve and when returning it to the storage position.

By way of indication, the magnitude of the axial retention force applied by the retaining means of the release device may be at least equal to 110%, and preferably at least equal to 120%, of the magnitude of the force of insertion of the applicator into the storage container.

By way of indication, the limit magnitude of thrust force that will be able to overcome this axial retention force may for example be less than or equal to 100 N (Newtons), or, better, less than or equal to 80 N, such that it is not excessively difficult for the user to retract the system into the sleeve.

Beyond this threshold magnitude, the axial thrust force applied by the user via the applicator will make it possible to disengage the retaining means and return the packaging and application system to its storage position. The user does not need to act on the release device in order to allow the system to return to its storage position inside the sleeve. This makes for more ergonomic usage.

Advantageously, the retaining means of the release device are configured to be active in the usage position of the packaging and application system relative to the sleeve independently of the actuation of the actuating means.

This design makes it possible to avoid undesired detachion of the said system from the sleeve, for example when the sleeve is grasped in order to reload the applicator with product.

The actuating means of the release device may be able to move radially in order to render the immobilizing means of the said device inactive. The sleeve of the protection device may comprise a lateral through-orifice into which the actuating means of the release device at least partially extends. This makes for easier access to the actuating means.

For preference, the retaining means of the release device collaborate with the storage container of the packaging and application system in the usage position.

According to a first design, the immobilizing means of the release device may equally collaborate with the storage container in the storage position. In that case, the immobilizing means and the retaining means of the release device collaborate preferably with distinct parts of the storage container.

According to a second design, the immobilizing means of the release device may collaborate with the sleeve of the protection device in the storage position.

In one embodiment, the release device comprises a ring axially secured to the sleeve of the protection device, mounted around the storage container of the application and storage system and comprising at least the immobilizing means and the actuating means for actuating the said immobilizing means.

What is meant by a "ring axially secured to the sleeve" is that the ring is fixed in the axial direction relative to the sleeve. The ring may be added to the sleeve. Alternatively, the ring may be produced in one piece with the sleeve, for example by moulding.

For preference, the ring is deformable, notably elastically deformable, so that when an external radial force is applied to the actuating means, the immobilizing means pass from the active position to the inactive position through deformation of the said ring at least in the region of the said immobilizing means.

According to one advantageous design, the ring may further comprise the retaining means. Alternatively, the sleeve could comprise the retaining means.

The retaining means may comprise at least one hook extending inwards. Is possible to provide a single hook that is continuous in the circumferential direction, or indeed a plurality of hooks spaced apart in the circumferential direction. The hook or hooks may collaborate with at least one projecting bulge of the storage container, or alternatively with at least one groove of the container.

The ring may comprise a through-opening formed radially in the thickness of the said ring, and having an upper edge which is situated in a radial plane containing the top of the said hook or situated axially above the said top, and a lower edge which is situated in a radial plane containing the base of the said hook, or axially below the said base.

In one embodiment, the elastic preload member is arranged axially between a bottom of the storage container of the packaging and application system and a bottom of the sleeve of the protection device.

Figure 2:
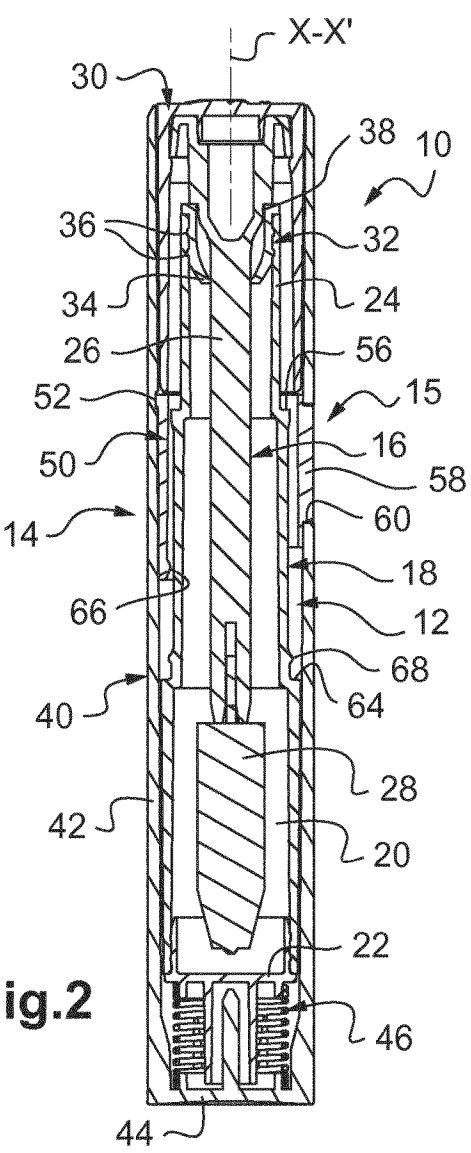
Figure 1:
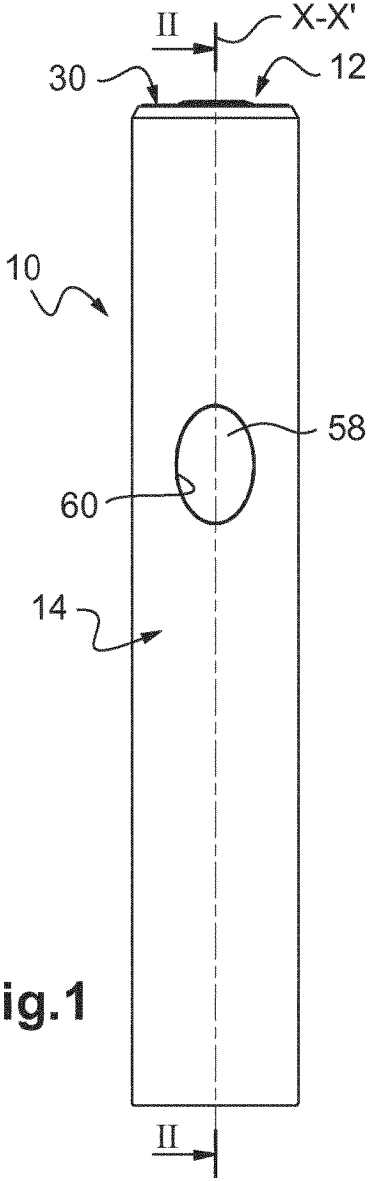
Figure 6:
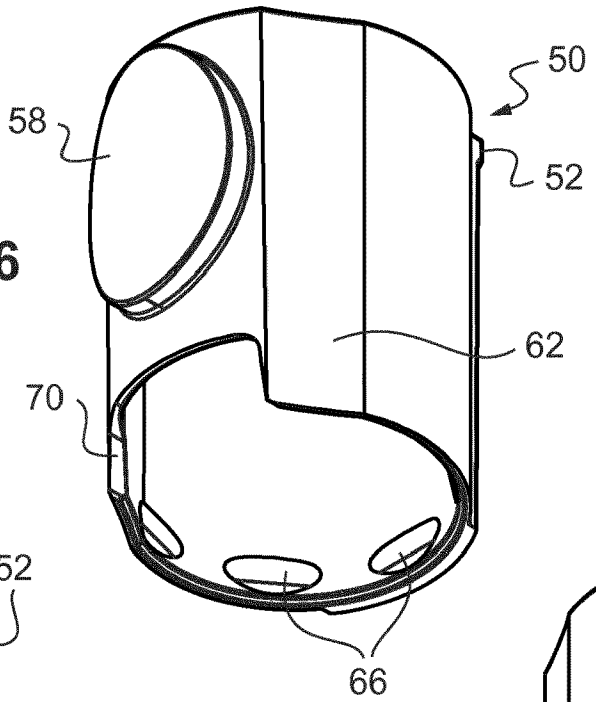
Figure 7:
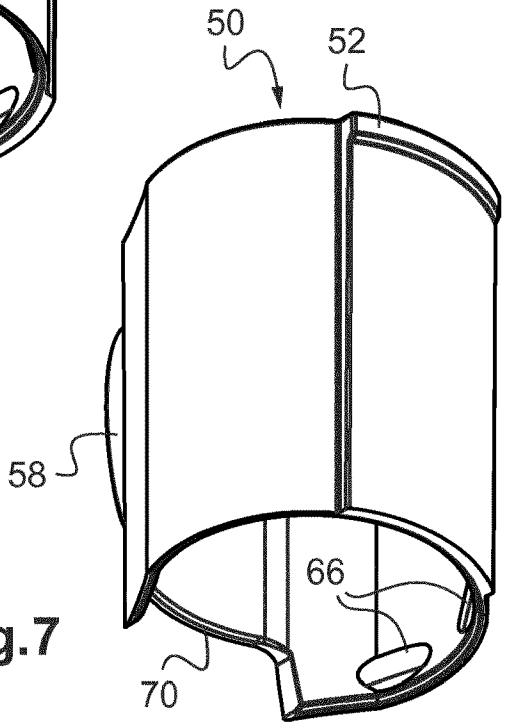
Figure 5:
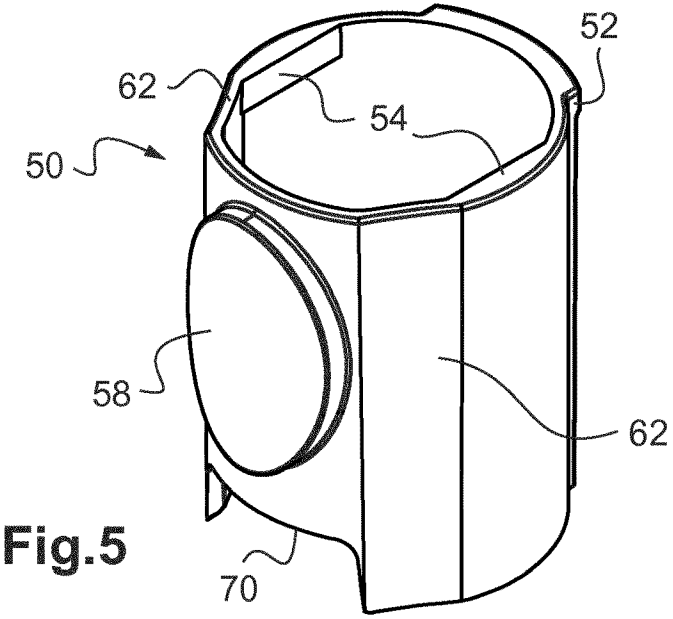
Figure 4:
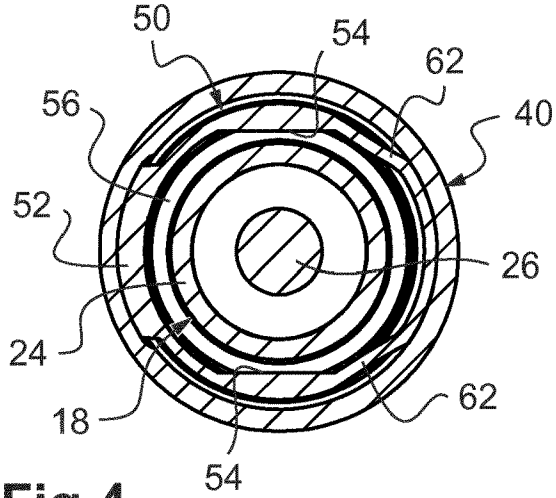
Figure 10:
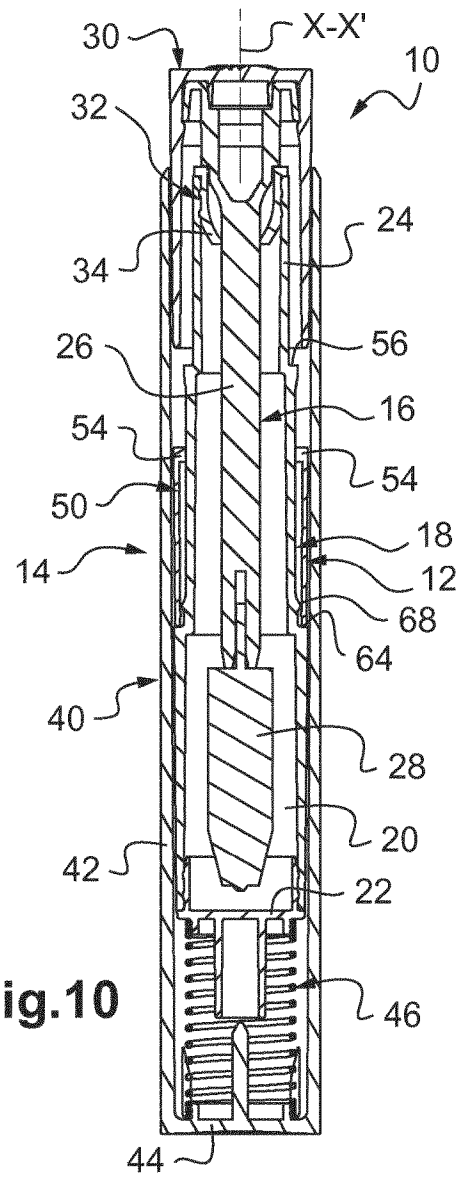
Figure 9:
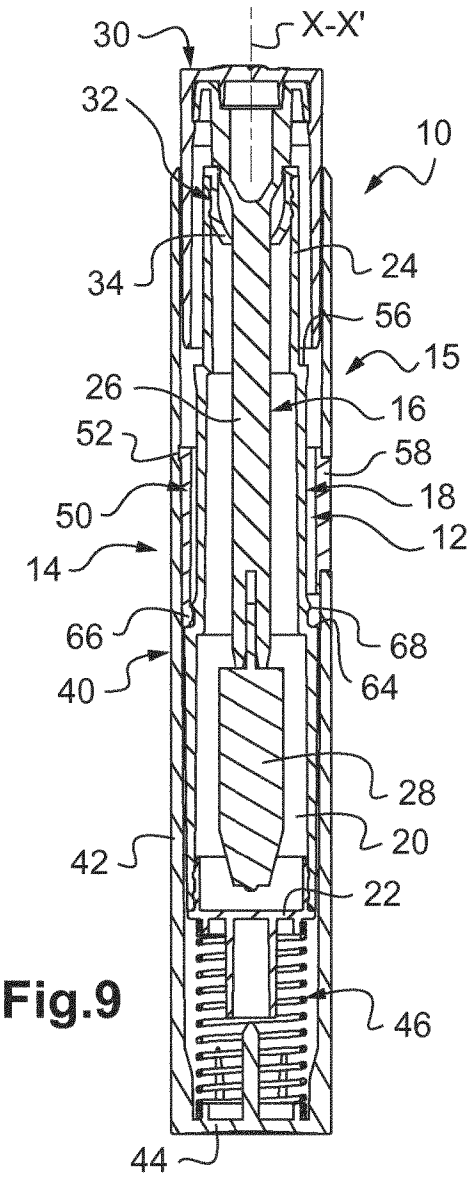
Figure 8:
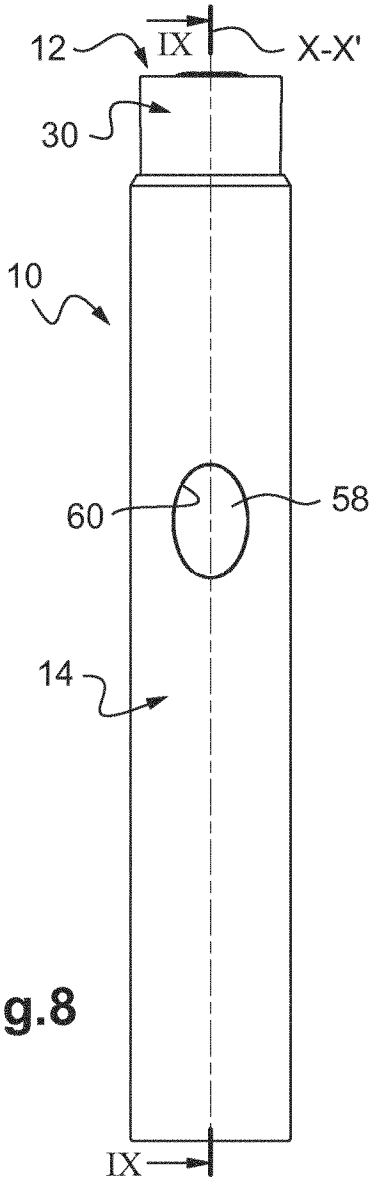
Figure 12:
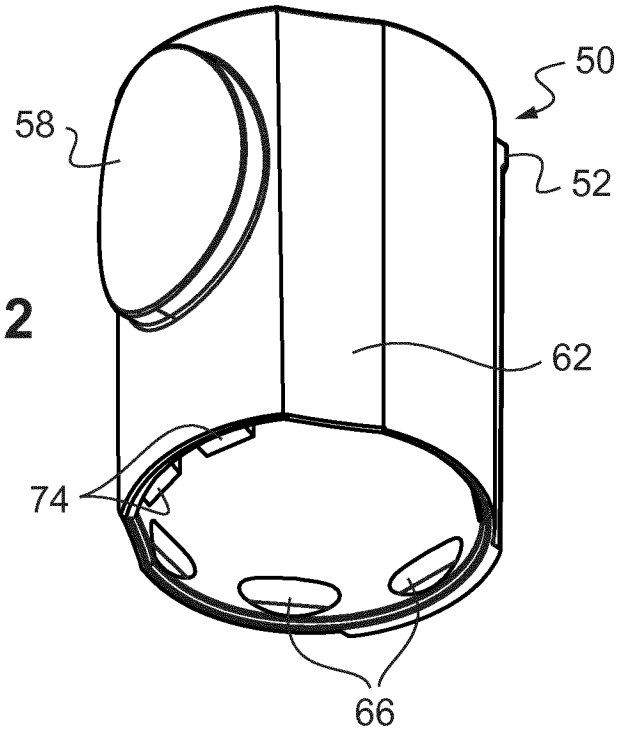
Figure 11:
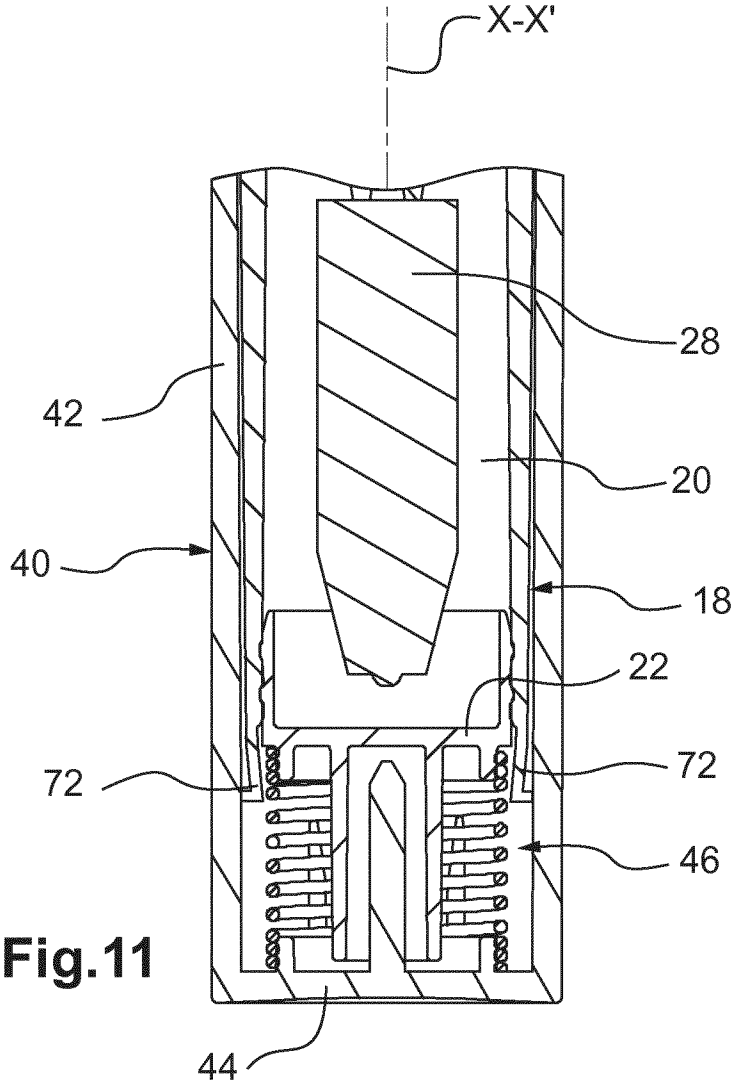

The present invention will be better understood from studying the detailed description of embodiments that are given by way of entirely non-limiting examples and are illustrated by the appended drawings, in which:

FIG. 1 is a front view of an assembly according to a first exemplary embodiment of the invention, in a storage position, FIG. 2 is a view of the assembly in longitudinal section on II-II of FIG. 1, FIG. 3 is a view of the assembly in longitudinal section on another plane of section, FIG. 4 is a view of the assembly in cross section on IV-IV of FIG. 3, FIGS. 5 to 7 are perspective views of a ring of the assembly of FIG. 1, FIG. 8 is a front view of the assembly of FIG. 1 in a usage position, FIG. 9 is a view of the assembly in longitudinal section on IX-IX of FIG. 8, FIG. 10 is a view of the assembly in longitudinal section on another plane of section, FIG. 11 is a partial section view of an assembly according to a second exemplary embodiment of the invention, in a storage position, and FIG. 12 is a perspective view of a ring of an assembly according to a third exemplary embodiment of the invention.

FIGS. 1 to 3 depict an assembly, denoted by the overall reference numeral 10, which comprises a system 12 for packaging and applying a product and a protection device 14 for protecting the said system. The assembly 10, of longitudinal axis X-X', is depicted in a position presumed to be vertical.

As will be described in greater detail hereinafter, the assembly also comprises a release device 15 to allow the system 12 to be immobilized and restrained relative to the device 14.

The system 12 is intended to allow packaging and application of a cosmetic product. The cosmetic product to be applied may, for example, be a make-up or care product, for example of the nail varnish, mascara or else lip gloss type.

The system 12 comprises a product applicator 16 and a storage container 18 containing the cosmetic product to be applied (not depicted). The container 18, of axis X-X', internally delimits an internal volume or reservoir 20 for storing the cosmetic product. The container 18 comprises an end forming a bottom 22, and an opposite open end forming a neck 24 that delimits an opening for access to the internal reservoir 20. In the exemplary embodiment illustrated, the bottom 22 takes the form of an added ring which is fixed to the reservoir by any suitable means, for example by snap-fastening. As an alternative, the bottom 22 may be produced as one piece with the container. In the exemplary embodiment illustrated, the container 18 has a circular cross section. In an alternative form, the container 18 may have a cross section that is polygonal, in particular square, or else an oval cross section.

The applicator 16, of axis X-X', comprises a stem 26, an application member 28 borne by the stem 26, and a member 30 for holding, secured to the stem 26 and positioned on the opposite side to the application member 28. The application member 28 is therefore connected to the member 30 for holding via the stem 26.

The applicator 16 is mounted on the container 18 with the ability to be removed between a pick-up position for picking up product contained in the container and an application position in which the said applicator is separated from said container. In the pickup position, at least part of the stem 26 and of the application member 28 are situated inside the reservoir 20 of the container so that the said application member is at least partially brought into contact with the product contained.

The application member 28 is mounted at the free end of the stem 26. The application member 28 is fixed to the stem 26 by any appropriate means, for example by wedging, screw fastening, bonding, crimping, etc. The application member 28 may comprise a foam, a felt, a flocked endpiece, a frit, a woven, a sponge, a paintbrush-type brush, a bottle-brush-type brush with or without a twisted core, a moulded brush, a comb or indeed a porous thermoplastic.

In the exemplary embodiment illustrated, the member 38 for holding and the stem 26 are two distinct components joined together by snap-fastening. Alternatively, the member 30 for holding and the stem 26 may be fixed by any other suitable means, for example by bonding, screw fastening, etc. In another alternative form, it is also possible to produce the member 30 for holding and the stem 26 as a single piece, for example moulded in plastic.

The applicator holding member 30 here radially surrounds the neck 24 of the container while remaining radially distant therefrom. As an alternative, it is possible to plan for radial contact between the member 30 for holding and the neck 24. In that case, the member 30 for holding also forms a stopper for sealing the container 18.

The system 12 also comprises an annular wiping member 32 fixed inside the neck 24 of the container and intended to wipe the stem 26 and the application member 28 when the applicator 16 is detached from the container. The wiping member 32 comprises, at its lower end, an annular wiping lip 34 extending obliquely in the direction of the stem 26 and, by its free end, defining a wiping orifice.

The wiping member 32 here comprises, at its upper end, an annular collar (unreferenced) which comes to bear axially against the neck 24 of the container. The wiping member 36 comprises, on its exterior surface, retaining bulges 36 for retaining the container 18 and which engage into corresponding grooves (unreferenced) formed on the interior surface of the neck 24 of the container. The retaining bulges 36 are two in number here and may be continuous or discontinuous in the circumferential direction.

The wiping member 32 comprises, on its interior surface, a sealing bulge 38 which presses sealingly against the stem 26 of the applicator. The sealing bulge 38 extends radially towards the inside and is continuous in the circumferential direction. The wiping member 32 is produced as a single piece, for example by moulding an elastomer or polyolefin material.

The protection device 14 comprises a sleeve 40 inside which the packaging and application system 12 is mounted with the ability to move axially between a retracted down storage position (FIGS. 1 to 3) and a deployed up usage position (FIGS. 8 to 10) in which the applicator 16 projects partially out from the sleeve so that it can be grasped by the user. When the system 12 is in the storage position, this applicator cannot be grasped by the user.

The cross section of the sleeve 40 can be defined according to that of the system 12. It may for example be circular, elliptical, polygonal such as square, rectangular, hexagonal, octagonal, etc. The sleeve 40 is advantageously made in a single piece by moulding a thermoplastic, for example a polyolefin (PO). As an alternative, the sleeve 40 may be made from a metallic material, for example from steel or from aluminium.

The sleeve 40 is intended to cover the system 12. The sleeve 40, of axis X-X', comprises a tubular peripheral wall 42 and a bottom 44 for closing off the lower end of the wall. The upper end of the peripheral wall 42 delimits an opening for mounting the system 12 inside the sleeve 40. In the exemplary embodiment illustrated, the wall 42 is thus open only at its upper end. Alternatively, the wall 42 could be open at its lower end also, the bottom 44 then in that case being attached to the wall 42 and fixed thereto, for example by screw fastening.

When the system 12 is in the storage position, the peripheral wall 42 of the sleeve radially surrounds the storage container 18 and the applicator holding member 30. The bottom 44 of the sleeve is situated axially some distance away from the bottom 22 of the container.

As will be described in greater detail later on, the assembly 10 further comprises an elastic preload member 46 which permanently applies elastic load to the packaging and application system 12 to allow the said system to pass from its storage position to its usage position.

The preload member 46 is arranged axially between the bottom 44 of the sleeve of the protection device and the bottom 22 of the container of the said system. The elastic preload member 46 here takes the form of a helical spring of which one end comes to bear against the bottom 44 of the sleeve and the other against the bottom 22 of the container.

The release device 15 performs a triple function, namely of immobilizing the packaging and application system 12 inside the sleeve 40 in its storage position, of rendering this immobilization inactive so as to allow the system to pass into its usage position, and of restraining the said system in this usage position in order to oppose a return to its storage position. The release device 15 may be produced as a single piece, or alternatively as several components.

In the exemplary embodiment illustrated, the release device 15 takes the form of an annular deformable ring 50 which is mounted around the storage container 18 of the packaging and application system. The ring 50 is mounted on the inside of the sleeve 40. The ring 50 is fixed to the peripheral wall 42 of the sleeve. The ring 50 here comprises, at its upper end, an attachment bulge 52 extending outwards and engaging in a corresponding groove (unreferenced) formed on the interior surface of the peripheral wall 42 of the sleeve. The bulge 52 is formed on the exterior surface of the ring 50.

The ring 50 also comprises, on the inside, hooks 54 (FIG. 3) for immobilizing the packaging and application system 12 inside the sleeve 40 in its storage position. The hooks 54 are formed on the interior surface of the ring 50. The hooks 54 are situated here at the upper end thereof. In the exemplary embodiment illustrated, the hooks 54 are two in number and are diametrically opposed.

When the system 12 is in the storage position, the hooks 54 are engaged with an annular shoulder 56 of the storage container. The shoulder 56 is formed between the neck 24 and the periphery of the container 18. The hooks 54 are situated axially above the shoulder 56 and come to bear axially against the said shoulder. When the system 12 is in the storage position, there is thus radial interference between the hooks 54 of the ring and the shoulder 56 of the container. The hooks 54 form means for axially immobilizing the system 12 relative to the protection device 14.

The ring 50 also comprises, on the outside, a stud 58 extending radially outwards into a lateral through-orifice 60 formed radially in the thickness of the peripheral wall 42 of the sleeve. The stud 58 is thus accessible from outside the sleeve 40. In the exemplary embodiment illustrated, the stud 58 lies flush with the exterior surface of the peripheral wall 42 sleeve. The stud 58 is formed on the exterior surface of the ring 50, in this instance diametrically opposite the bulge 52. The stud 58 has an oval shape. Alternatively, the stud 58 could have other shapes, for example cylindrical, polygonal, etc.

The stud 58 forms a means for actuating the hooks. When the user depresses the stud 58 by applying a radial force directed towards the inside of the sleeve 40, this causes deformation of the ring 50 which has the effect of separating the books 54 in an outward direction so that they are then no longer in engagement with the shoulder 56 of the storage container. The container 18 and, more generally, the system 12, is released and can move towards its usage position under the effect of the preload member 46. The preload member 46 is dimensioned in such a way as to be constrained or compressed axially between the sleeve 40 and the container 18 when the hooks 54 are engaged with the latter.

Under the effect of the radial force applied by the user, the inwards radial movement of the stud 58 of the ring therefore allows the hooks 54 of the said ring to be moved from an active position that immobilizes the system 12 inside the sleeve 40 into an inactive position that allows the system to move axially relative to the sleeve towards its usage position. Once the radial force applied by the user ceases, the ring 50 reverts to its initial position through elastic return.

In the exemplary embodiment illustrated, the ring 50 has a special shape to encourage the outwards movement of the hooks 54 during user actuation of the stud 58. As illustrated more visibly in FIGS. 4 and 5, the ring 50 here in cross section has a shape that is convex circular with the exception of two portions 62 of concave shape each extending between the portion supporting the stud 58 and the portion supporting the associated hook 54. As an alternative, it is, however, possible to provide a ring 50 that has a cross section of purely convex circular shape.

As indicated previously, once the hooks 54 are no longer engaged with the shoulder 56 of the storage container, the preload member 46 allows the system 12 to move into its usage position in which the applicator holding member 30 extends as a partial projection out from the sleeve 40. During this movement, the container 18 slides inside the ring 50 and inside the sleeve 40.

As can be seen in FIGS. 9 and 10, in this usage position, the lower end of the ring 50 forms an end stop for a shoulder 64 of the container which is formed on the periphery thereof. The shoulder 64 is situated axially below and some distance away from the shoulder 56. This end stop makes it possible to avoid the container 18 being extracted from the sleeve 40 under the effect of the axial load applied by the preload member 46, or else when the user is taking hold of the stoppering member 30. Thus, the container 18 remains housed inside the sleeve 40 of the protection device, only the applicator 16, via the stoppering member 30, projecting axially relative to the upper end of the said sleeve and being able to be detached from the container 18 for the purpose of applying product.

In an alternative form of embodiment, it might be possible to provide, on the interior surface of the sleeve 40, axially below the ring 50, a radial shoulder for performing this end-stop function.

As indicated previously, the release device 15 also serves to restrain the system 12 in the usage position to oppose a return towards its storage position.

To this end, as notably illustrated in FIGS. 6, 7 and 9, the ring 50 comprises, on the inside, hooks 66 that extend radially inwards. The hooks 66 are formed on the interior surface of the ring 50. The hooks 66 are formed near the lower end of the ring 50. The hooks 66 are spaced apart from one another in the circumferential direction, in this case regularly.

When the system 12 is in the usage position, the hooks 66 are engaged with an annular bulge 68 formed on the storage container and arranged axially below the said bulge. The bulge 68 is situated axially above the shoulder 64. The bulge 68 extends radially outwards.

When the system 12 is in the usage position, there is radial interference between the hooks 66 of the ring and the bulge 68 of the container, making it possible to oppose an axial movement of the system 12 relative to the protection device 14 towards its storage position. The hooks 66 of the ring provide this axial retention of the system 12 by clip-fastening the container to the sleeve 40.

The hooks 66 of the ring are configured to apply an axial retention force on the system 12 relative to the sleeve 40 which is higher than the axial thrust force that the user has to exert in order to introduce the applicator 16 into the container 18 in its pickup position. The hooks 66 exert this axial retention force on the bulge 68 of the container.

As indicated previously, in the exemplary embodiment illustrated, the container 18 is equipped with the wiping member 32. When the user thrusts the applicator 16 into the container 18 towards its pickup position, the friction contact occurs chiefly at the wiping lip 34 of the wiping member which rubs radially against the application member 28 and then the stem 26 of the applicator. The hooks 66 of the ring are configured to apply an axial retention force which is higher than the thrust force that the user has to exert in order to introduce the applicator 16 into the container 18 taking this friction into account.

Alternatively, if the container 18 is not equipped with a wiping member, the friction contact there is between the applicator 16 and the container 18 as the said applicator is being introduced may, for example, occur at the neck of the container.

In general, the axial retention force of the hooks 66 of the ring is intended to be higher than the axial thrust force that the user needs to exert in order to introduce the applicator 16 into the container 18 taking into account the friction that there is between these two during this introduction irrespectively of whether or not a wiping member is present.

Thus, when the user wishes to reload the application member 28 of the applicator with product and dips the said applicator into the container 18, it is assured that the friction contact between the applicator 16 and the latter will not cause the said container to move axially towards the bottom 44 of the sleeve.

Beyond a predetermined magnitude of threshold thrust force needed to overcome the axial retention force applied by the hooks 66 of the ring, the force applied by the user will allow the hooks 66 to disengage from the bulge 68 of the container. The bulge 68 of the container therefore slides under the hooks 66 of the ring.

In order to facilitate this disengagement, a through-opening 70 is formed radially in the thickness of the ring 50 from the lower end thereof. The opening 70 is situated axially below the stud 58 and extends over a limited angular sector. In the axial direction, the opening 70 extends as far as a radial plane situated axially above the tops of the hooks 66.

When the force applied by the user is greater than the axial retaining force of the hooks 66 on the ring, the container 18 moves axially downwards, i.e. towards the bottom 44 of the sleeve. This axial movement of the container 18 takes place against the axial preload applied by the elastic preload member 46 produced here in the form of a helical spring. Specifically, the preload member 46 is dimensioned so as to be compressed axially between the sleeve 40 and the container 18 when the system 12 is in the storage position, as indicated hereinabove, but also when it is in its usage position.

The force applied by the user allows the container 18 of the packaging and application system to return to its storage position in which the hooks 54 of the ring are engaged with the shoulder 56 of the container, as illustrated in FIG. 3.

In order to cause the system 12 to pass from its usage position to its storage position, all the user has to do is apply, to the applicator 16 inserted beforehand into the container 18, an axial force that is higher than the axial retention force of the hooks 66 of the ring. The user does not need to act on the ring 50 in order to allow the system 12 to return to its storage position inside the sleeve 40. This makes for better ergonomics when storing the system 12 inside the sleeve 40 of the protection device.

When the user wishes to reuse the system 12, he/she acts on the stud 58 to release the hooks 54 of the ring from the shoulder 56 of the container and cause the automatic sliding of the system that makes the applicator 16 at least partially project outside the sleeve 40. The hooks 66 of the ring are configured to allow the bulge 68 of the container to pass over the said hooks during this sliding, under the effect of the axial force applied by the preload member 46. Next, as indicated previously, in the usage position of the system 12, the hooks 66 oppose the return of the system 12 to the storage position.

For preference, the magnitude of the axial retention force applied by the hooks 66 of the ring may be at least equal to 110%, and preferably at least equal to 120%, of the magnitude of the axial thrust force that the user must exert in order to introduce the applicator 16 into the container 18.

By way of indication, when the application member 28 of the applicator is a bottlebrush-type brush, the force applied by the brush as it passes the wiping member 32 in the direction of introduction is comprised between 2 N and 60 N, with a wiping orifice diameter smaller by 1 mm than the maximum diameter of this brush.

For example, when the force applied by the brush of the application member 28 when it passes the wiping member 32 in the direction of introduction is 2 N, or, respectively, 60 N, the threshold magnitude of thrust force required to overcome the axial retention force applied by the hooks 66 of the ring may be fixed at 2.5 N or 75 N, respectively.

By way of indication, the limit magnitude of thrust force needed to overcome this axial retention force may for example be less than or equal to 100 N, or, better, less than or equal to 80 N, such that it is not excessively difficult for the user to retract the container 18 into the sleeve 40.

Thus, in the aforementioned exemplary embodiments, in which the force applied by the brush of the application member 28 when it passes the wiping member 32 in the direction of introduction is 2 N, or, respectively, 60 N, the limit magnitude of thrust force needed to overcome this axial retention force may be fixed at 5 N or 80 N, respectively.

A person skilled in the art will know how to adjust the threshold magnitude of thrust force and the limit magnitude of this thrust force according to the bearing made up of "application member 28/wiping member 32" used in the system 12 in order to obtain a good compromise between, on the one hand, axial retention of the system in a usage position partially projecting out of the sleeve 40 when the user wishes to reload the application member 28 of the applicator with product and, on the other hand, the ease with which the system 12 can be retracted into the sleeve 40 after use.

The exemplary embodiment illustrated in FIG. 11, in which identical elements bear the same references, differs from the first exemplary embodiment solely in that the container 18 is equipped, at its lower end, with flexible tabs 72 extending axially downwards. The tabs 72 come to bear radially against the interior surface of the peripheral wall 42 of the sleeve. The tabs 72 are configured so as to be deformed radially inwards by contact with the peripheral wall 42 of the sleeve when the container 18 is introduced into the latter. Thus, the tabs 72 of the container permanently apply a radial load to the wall 42 of the sleeve, thereby making it possible to stabilize the container 18 in the radial direction with respect to the sleeve 40, particularly in its usage position. This then improves the stability of the container 18 in the radial direction when it is partially extracted from the sleeve 40, notably when the user is dipping the applicator into the container 18 in order to reload the application member 28 of the applicator with product.

To this end, in addition or as an alternative, it is also possible to plan for the ring 50 be devoid of the through-opening described hereinabove in connection with the first exemplary embodiment, as illustrated in FIG. 12.

With such a design, it is thus possible to provide, in that portion of the ring 50 that is intended to replace this through-opening, additional hooks or scalloping 74, extending radially inwards, and different in height and/or in shape compared with the hooks 66 so that these hooks all together define a cross section of a shape and size similar to the section of the container. Thus, the stability of the container 18 in the radial direction with respect to the sleeve 40 is also improved, particularly in the usage position of the container 18 with respect to the sleeve 40.

The invention thus makes available a device that affords the user good ergonomics of use while at the same time avoiding the container 18 moving while the user is reloading the applicator 16 with product in the deployed up usage position of the system 12.

The invention claimed is:

1. Assembly comprising a product packaging and application system and a protective device for protecting the said system, the said system comprising a container for storing the said product and an applicator mounted so that it can be moved between a pickup position for picking up product contained in the said container and an application position in which the applicator is separated from the said container, the protection device comprising a sleeve inside which the packaging and application system is mounted in such a way that it can move axially between a storage position and a usage position in which at least the applicator extends partly projecting out of the sleeve, the assembly further comprising a device for release the packaging and application system comprising a ring axially secured to the sleeve of the protection device and mounted around the storage container of the application and storage system, said ring being provided inside with first hooks immobilizing the said system relative to the sleeve in the storage position, and provided on the outside with a stud for rendering the first hooks inactive and detaching the said system and the said sleeve by actuating the said stud, and an elastic preload member applying elastic load to the packaging and application system for the passage of the said system from the storage position to the usage position when the first hooks are in the inactive position, wherein the release device further comprises on the inside, second hooks for restraining the said system relative to the sleeve in the usage position and which are configured to oppose the movement of the said system towards the storage position, wherein the ring is deformable, so that, when an external radial force is applied to the stud, the first hooks pass from the active position to the inactive position through deformation of the said ring in the region of the first hooks, and wherein the second hooks are active in the usage position of the system relative to the sleeve independently of the actuation of the stud and the deformation of the ring.

2. Assembly according to claim 1, wherein the second hooksof the release device are configured to apply an axial retaining force restraining the said system relative to the sleeve and which force is higher than a force of insertion of the applicator into the storage container.

3. Assembly according to claim 2, wherein the said axial retention force is higher than the axial load applied by the elastic preload member when the packaging and application system is in the usage position.

4. Assembly according to claim 2, wherein the magnitude of the said axial retention force is at least equal to 110%, and preferably at least equal to 120%, of the magnitude of the force of insertion of the applicator into the storage container.

5. Assembly according to claim 1, wherein the second hooks of the release device collaborate with the storage container of the packaging and application system in the usage position.

6. Assembly according to claim 1, wherein the first hooks of the release device collaborate with the storage container of the packaging and application system in the storage position.

7. Assembly according to claim 6, wherein the first hooks and the second hooks of the release device collaborate with distinct parts of the storage container.

8. Assembly according to claim 1, wherein the ring is deformable, so that, when an external radial force is applied to the stud, the first hooks pass from the active position to the inactive position through deformation of the said ring at least in the region of the said first hooks.

9. Assembly according to claim 1, wherein the ring further comprises the second hooks.

10. Assembly according to claim 1, wherein the stud of the release device is able to move radially in order to render the first hooks of the said device inactive.

11. Assembly according to claim 1, wherein the sleeve of the protection device comprises a lateral through-orifice into which the stud of the release device at least partially extends.

12. Assembly according to claim 1, wherein the elastic preload member is arranged axially between a bottom of the storage container of the packaging and application system and a bottom of the sleeve of the protection device.

13. Assembly comprising a product packaging and application system and a protective device for protecting the system, the system comprising a container for storing the product and an applicator mounted so that it can be moved between a pickup position for picking up product contained in the container and an application position in which the applicator is separated from the container, the protection device comprising a sleeve inside which the packaging and application system is mounted in such a way that it can move axially between a storage position and a usage position in which at least the applicator extends partly projecting out of the sleeve, and assembly further comprising a device for release the packaging of and application system comprising a ring axially secured to the sleeve of the protection device and mounted around the storage container of the application and storage system, said ring being provided on the inside with first hooks immobilizing the said system relative to the sleeve in the storage position, and provided on the outside with a stud for rendering the first hooks inactive and detaching the system and the sleeve by actuating the stud, and an elastic preload member applying elastic load to the packaging and application system for the passage of the system from the storage position to the usage position when the first hooks are in the inactive position, wherein the ring of the release device further comprises on the inside second hooks for restraining the system relative to the sleeve in the usage position and which are configured to oppose the movement of the said system towards the storage position, wherein the ring is deformable so that, when an external radial force is applied to the stud, the first hooks pass from the active position to the inactive position through deformation of the ring in the region of the first hooks, and wherein when the external radial force is applied to the stud, the ring is not deformable in the region of the second hooks, such that the second hooks are always active.

* * * * *